US005473842A

United States Patent [19]

Hillery

[11] Patent Number: 5,473,842

[45] Date of Patent: Dec. 12, 1995

[54] ROOFTOP ACCESS SYSTEM

[75] Inventor: Herbert R. Hillery, Mystic, Conn.

[73] Assignee: Hillery Realty Company, Inc., Groton, Conn.

[21] Appl. No.: 308,380

[22] Filed: Sep. 19, 1994

[51] Int. Cl.[6] ..... E06B 1/04

[52] U.S. Cl. ..... 49/504; 49/380; 49/402

[58] Field of Search ..... 49/380, 402, 381, 49/504, 463; 52/204.1

[56] References Cited

U.S. PATENT DOCUMENTS

| | | | |
|---|---|---|---|
| 1,271,210 | 11/1918 | Otte . | |
| 1,628,249 | 5/1927 | Kirfman . | |
| 2,282,733 | 5/1942 | Malloy . | |
| 2,319,415 | 5/1943 | Lightfoot | 49/380 X |
| 2,793,721 | 5/1957 | Sterud . | |
| 3,156,954 | 11/1964 | Haught | 49/380 X |
| 3,286,405 | 11/1966 | Schembri . | |
| 3,537,212 | 11/1970 | Gilles | 49/381 |
| 3,562,955 | 2/1971 | Blomgren | 49/402 X |
| 3,858,355 | 1/1975 | Root . | |
| 4,555,867 | 12/1985 | Stibolt | 49/402 X |
| 4,890,418 | 1/1990 | Sachs | 49/380 X |

*Primary Examiner*—Philip C. Kannan
*Attorney, Agent, or Firm*—Lahive & Cockfield

[57] ABSTRACT

A rooftop access for an HVAC sheet metal enclosure is provided by cutting a T-shaped opening in a wall of the enclosure and inserting a frame with a door and a peripheral flange, the upper portion of which is inserted through the slot at the top of the opening. The flange upper portion includes a flashing, projecting over the frame below.

5 Claims, 5 Drawing Sheets

ROOFTOP ACCESS SYSTEM

This invention relates generally to frames for enclosure openings, and more particularly to access door frames added to sheet metal enclosures, such as those housing heating, ventilating and air conditioning (HVAC) equipment on the rooftops of buildings.

BACKGROUND OF THE INVENTION

Heating, ventilation and air conditioning equipment on the tops of buildings is often housed in sheet metal enclosures. Access doors for the enclosures may be provided when the enclosures are set up, or they may be added later. In either event, it is desirable to provide an efficient, easy-to-install, adequate access door frame for such enclosures. It is an object of this invention to provide such a frame.

SUMMARY OF THE INVENTION

The invention provides an enclosure access system, comprising a sheet metal enclosure with a wall, the wall having a slot and a frame opening, and a sheet metal access frame, the access frame including an inner frame inserted in the frame opening, that has a peripheral flange extending transversely from the inner frame to cover at least a portion of the edge of the frame opening, the peripheral flange including an insertion flange portion inserted through the slot.

Preferably, the slot and the frame opening comprise a single, T-shaped, opening; and the slot is a horizontal slot above the frame opening, with the insertion flange portion including a flashing portion extending horizontally along substantially the length of the insertion flange portion. A door is preferably hingedly mounted in the frame.

DESCRIPTION OF THE DRAWINGS

Other objects, features and advantages of the invention will be described in, or will be readily apparent from, the following description of a preferred embodiment of the invention, including the drawings thereof, in which.

DETAILED DESCRIPTION OF A PREFERRED EMBODIMENT

Figure 6:
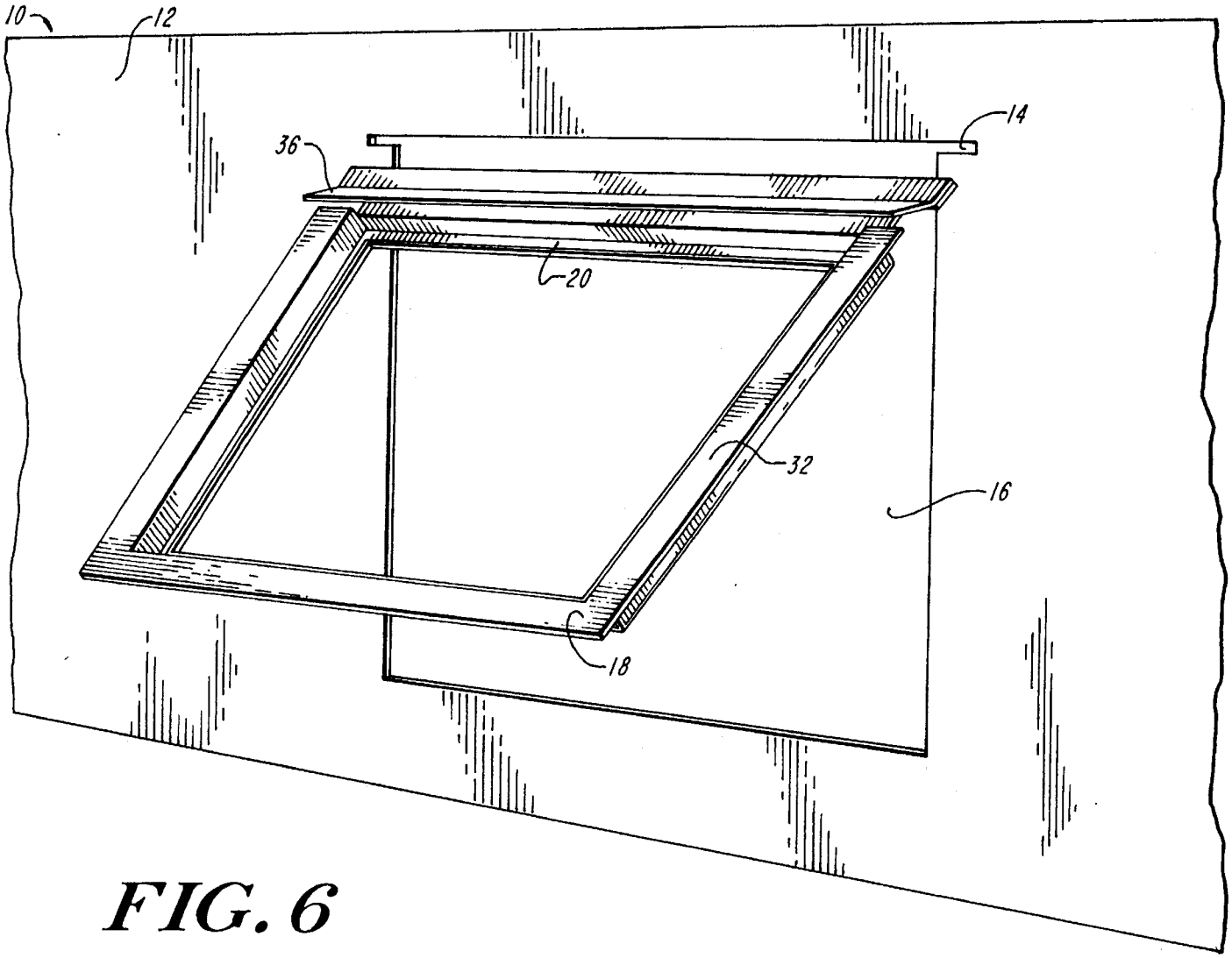
FIG. 6 is a perspective view, showing an opening in an enclosure, and the frame in position to be inserted into the opening.

The rooftop access system is used with the typical rooftop sheet metal enclosures 10 for heating, ventilating and air-conditioning equipment. Such an enclosure 10 is not shown completely in the drawings, but a portion of a wall 12 of such an enclosure 10 is shown in FIG. 6.

The wall 12 of the enclosure 10 has a horizontal slot 14, and a rectangular frame opening 16 extending down from the slot 14. The slot 14 is selected to be of some length slightly longer than width of the frame opening 16. The slot 14 and opening 16 are connected, that is, the opening 16 essentially extends down from the slot 14, so that the entire opening is in the shape of a "T".

Figure 1:
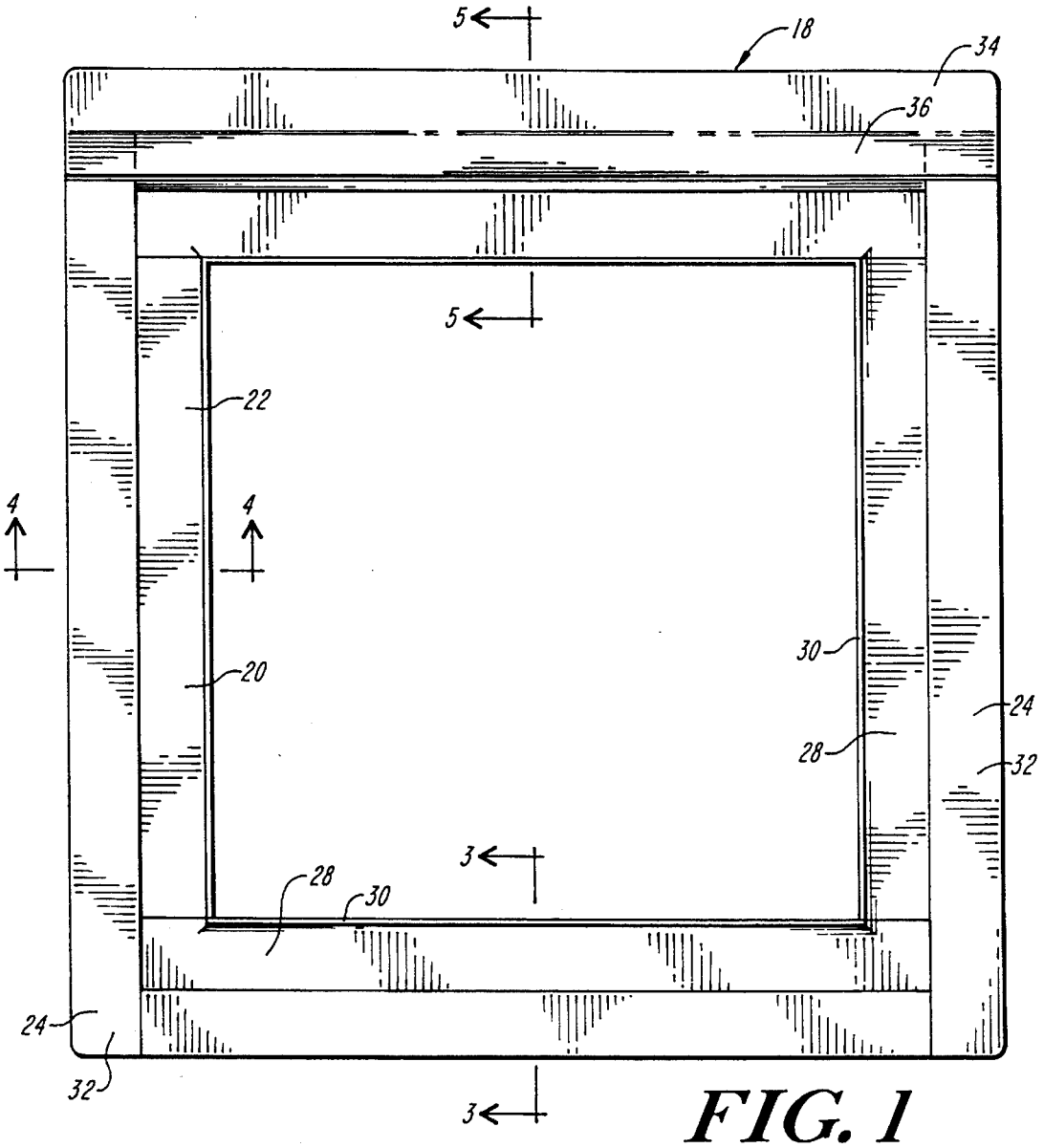
FIG. 1 is a front view of a frame constructed according to the invention.
Figure 3:
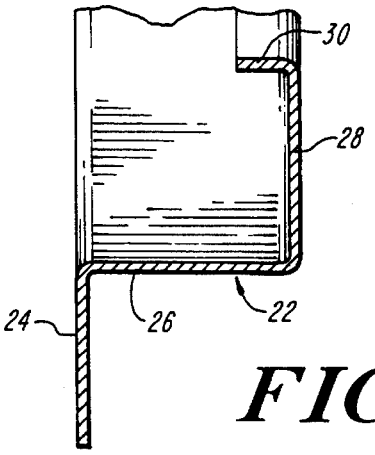
FIG. 3 is a sectional view of a portion of the frame of FIG. 1, along the lines 3—3 of FIG. 1.
Figure 2:
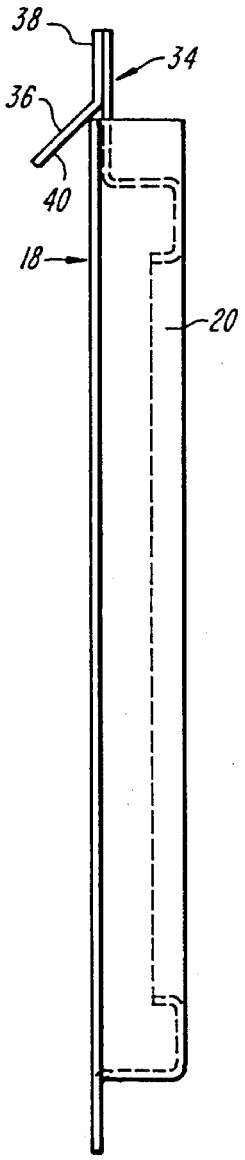
FIG. 2 is a side view of the frame of FIG. 1.
Figure 4:
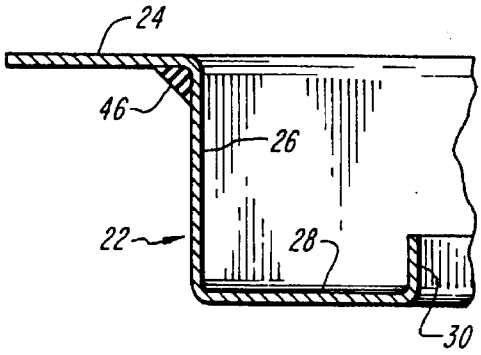
FIG. 4 is a sectional view of another portion of the frame of FIG. 1, along the line 4—4 of FIG. 1.

As shown in FIGS. 1 and 2, a sheet metal access frame 18 for the system includes an inner rectangular frame 20, corresponding in shape to the frame opening 16 and insertable through it. The frame 20 is made up of channel members 22, each of which has a front portion 24 that is parallel with the enclosure wall 12, a lateral portion 26 extending transversely back from the front portion 24, and a back portion 28 extending transversely inwardly (toward the center of the frame) from the lateral portion 26 (see FIGS. 3 and 4). The back portion 28 of the channel member 22 is thus parallel to the front portion 24. Finally, a lip portion 30 extends forwardly from the channel member back portion 28.

The front portions 24 of the channel members 22 of the frame 18 form a peripheral flange 32 that is parallel to the enclosure wall 12. The flange 32 surrounds the frame 18 and covers the side and bottom edges of the frame opening 16.

Figure 5:
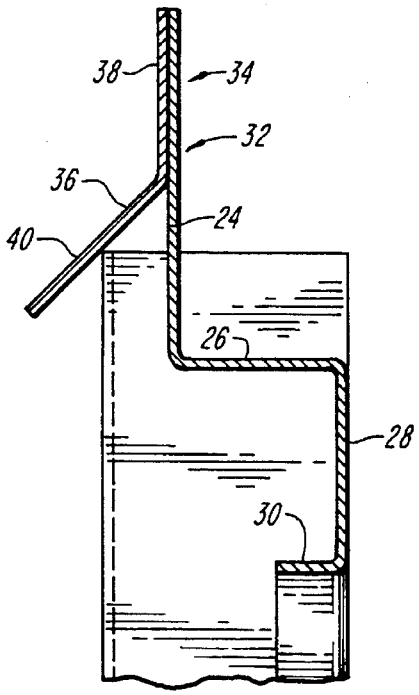
FIG. 5 is a sectional view of the top portion of the frame of FIG. 1, along the line 5—5 of FIG. 1.

The peripheral flange 32 includes a top portion 34 that is insertable through the slot 14 at the top of the T-shaped opening. As shown in FIG. 5, the top flange portion 34 has a horizontally extending sheet metal flashing 36 tack-welded to it. The flashing 36 has a back portion 38 that is tack-welded to the flange, and a front portion 40 that is bent at a forward angle from the back portion, to project over the remainder of the frame 18 below. The flashing 36 extends for substantially the entire length of the flange top portion 34, so that is projects over the entire width of the frame 18.

Figure 8:
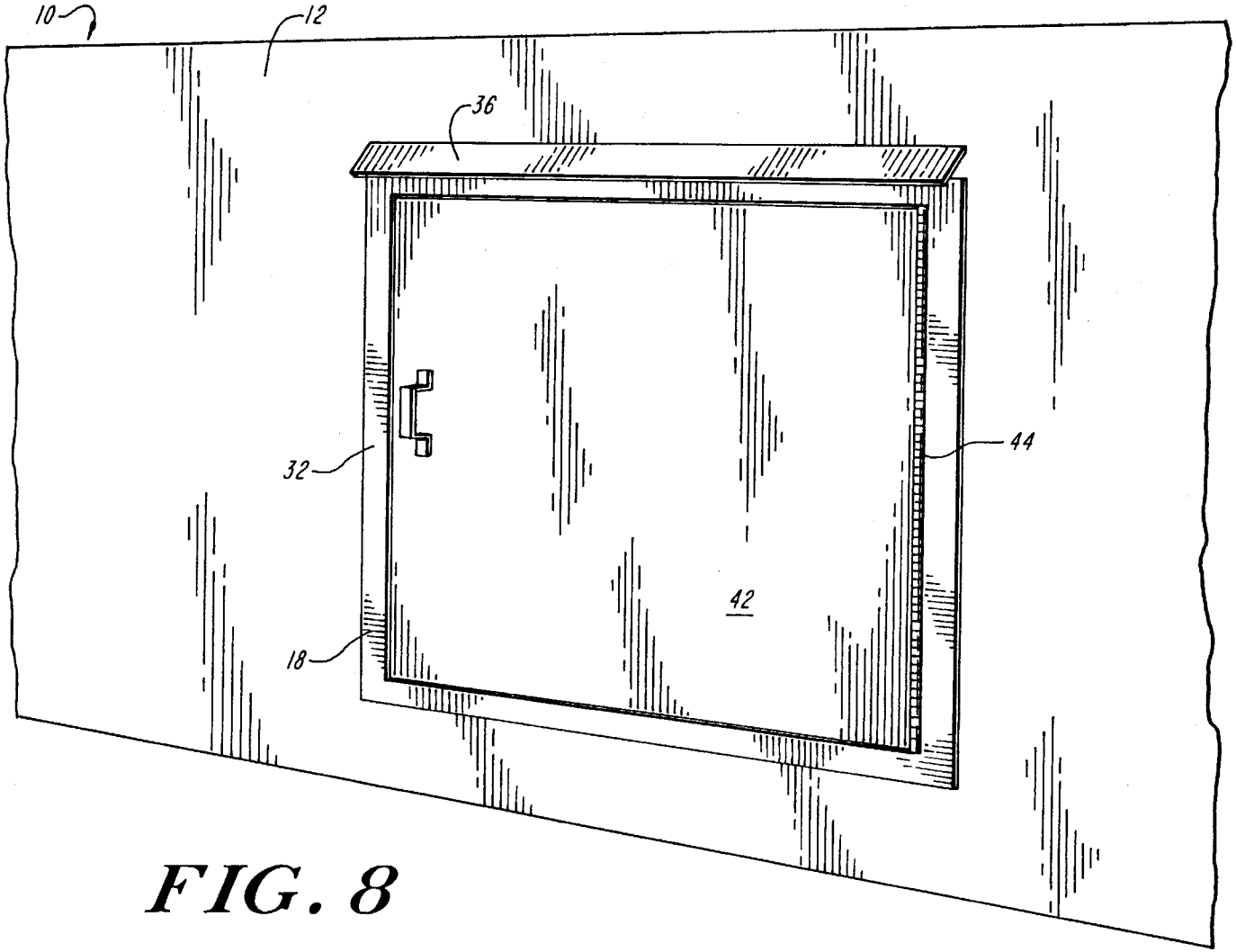
FIG. 8 is a perspective view of the frame installed, in which a door is mounted in the frame.

A door 42 is mounted on the frame 18 with a piano hinge 44, to provide access to the interior of the enclosure 10 after the frame is installed (see FIG. 8).

The invention is particularly well adapted to retrofitting a sheet metal rooftop enclosure that may not have had an access door when it was originally assembled, although it may also be used in the original assembly of such an enclosure.

To install the rooftop access system, an installer merely has to cut the appropriately sized "T-slot" opening in the wall 12 of the enclosure 10. The opening would conform to the size of the access frame 18 to be installed.

Figure 7:
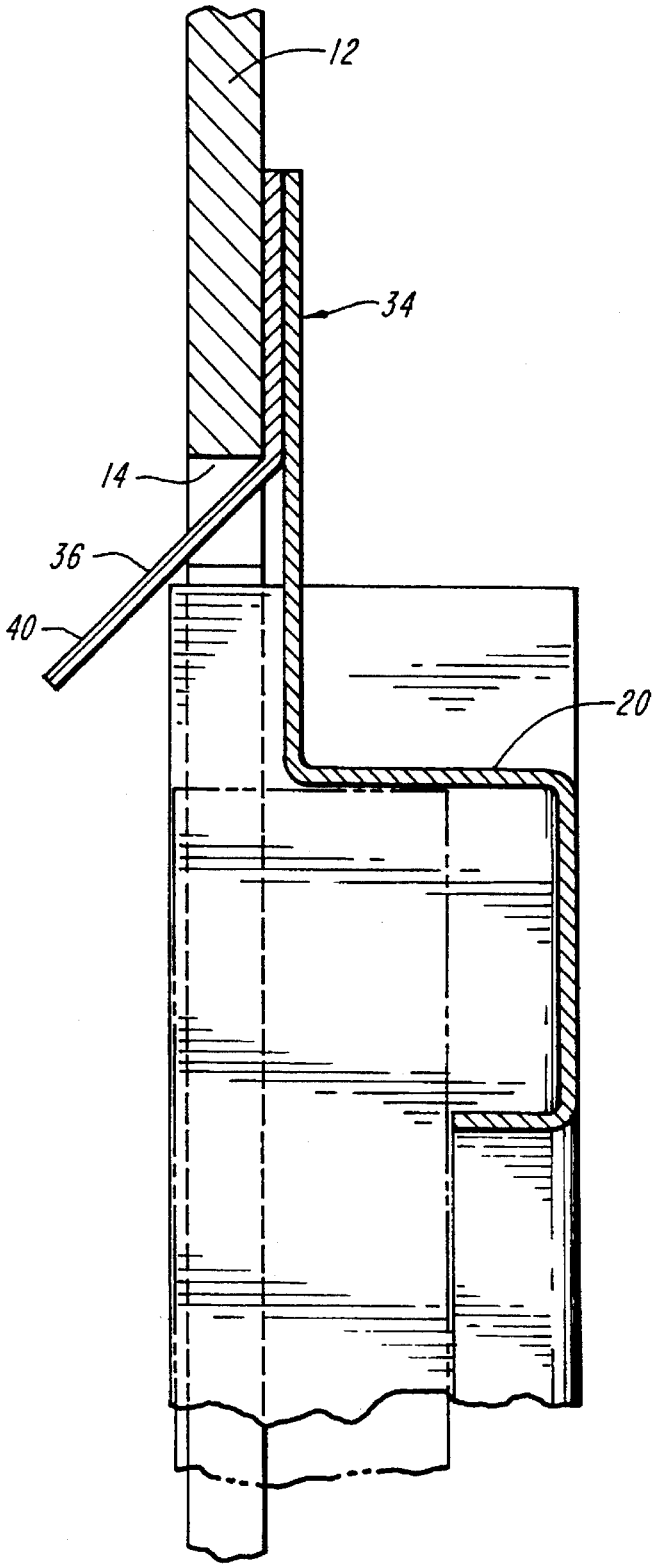
FIG. 7 is a view like that of FIG. 5, showing the upper portion of the frame inserted in the slot of the opening.

As shown in FIGS. 6 and 7, the access frame 18 is then lifted, and the top flange portion 34 is inserted, from outside the enclosure 10, in a generally horizontal movement, through the slot 14. The access frame 18 is then allowed to pivot down, and the inner frame 20 is inserted in the frame opening 16. A bead of caulking 46 is preferably laid on the inside of the flange 32 to provide a seal between the frame 18 and the enclosure wall 12. The flange 32 is preferably tack-welded to the enclosure wall 12 to make the installation secure.

A weathertight access to the enclosure 10 is thereby obtained. The flashing 36 at the top of the frame 18 protects the frame below. Thus a weathertight access door can be added to a rooftop sheet metal enclosure simply and effectively using the system of the invention.

While an illustrative and preferred embodiment of the invention has been described, alternatives to aspects of the embodiment, and other modifications, can be made by those skilled in the art without departing from the spirit and scope of the invention, which is described in the following claims.

I claim:

1. An enclosure access system, comprising a sheet metal enclosure including at least one sheet metal wall, said sheet metal wall defining a slot of predetermined length, and a frame opening, a sheet metal access frame, comprising an inner frame inserted in said frame opening, a peripheral flange extending transversely from said inner frame to cover at least a portion of the edges of said frame opening, said peripheral flange including an insertion flange portion inserted through said slot.

2. The enclosure access system of claim 1, wherein said slot and said frame opening comprise a single, T-shaped, opening.

3. The enclosure access system of claim 1, wherein said slot is a horizontal slot above said frame opening, and said insertion flange portion includes a flashing portion extending horizontally along substantially the length of said insertion flange portion.

4. The enclosure access system of claim 1, including a door hingedly mounted in said frame.

5. An enclosure access system, comprising a sheet metal enclosure including at least one sheet metal wall, said sheet metal wall defining a horizontal slot of predetermined length and a frame opening narrower than said horizontal slot extending downwardly from said horizontal slot, a sheet metal access frame, comprising an inner frame inserted in said frame opening, a peripheral flange extending transversely from said inner frame to cover the side and bottom edges of said frame opening, said peripheral flange including a top insertion flange portion inserted through said slot, said top insertion flange portion including a flashing extending along said substantially the length of said top insertion flange portion, and a door hingedly mounted in said sheet metal access frame.

* * * * *